US007644757B2

(12) United States Patent
Artherholt

(10) Patent No.: US 7,644,757 B2
(45) Date of Patent: Jan. 12, 2010

(54) FIXED-POINT PACKOFF ELEMENT WITH PRIMARY SEAL TEST CAPABILITY

(75) Inventor: Danny Lee Artherholt, Asher, OK (US)

(73) Assignee: Stinger Wellhand Protection, Inc., Oklahoma City, OK (US)

( * ) Notice: Subject to any disclaimer, the term of this patent is extended or adjusted under 35 U.S.C. 154(b) by 119 days.

(21) Appl. No.: 11/824,691

(22) Filed: Jul. 2, 2007

(65) Prior Publication Data

US 2009/0008100 A1 Jan. 8, 2009

(51) Int. Cl.
*E21B 33/10* (2006.01)
*E21B 47/10* (2006.01)

(52) U.S. Cl. ..... 166/113; 166/85.3; 166/115; 166/250.08

(58) Field of Classification Search ..... 166/337, 166/113, 115, 85.3, 250.08; 73/40.5 R, 49.1
See application file for complete search history.

(56) References Cited

U.S. PATENT DOCUMENTS 2,904,115 A * 9/1959 Turner ..... 166/115
3,153,845 A * 10/1964 Loomis ..... 29/705
3,531,236 A * 9/1970 Braddick et al. ..... 166/285
3,830,304 A 8/1974 Cummins
4,023,814 A 5/1977 Pitts
4,111,261 A 9/1978 Oliver
4,385,643 A * 5/1983 Noe ..... 138/90
4,407,171 A * 10/1983 Hasha et al. ..... 73/46
4,601,494 A 7/1986 McLeod et al.
4,867,243 A 9/1989 Garner et al.
4,993,489 A 2/1991 McLeod
5,060,723 A 10/1991 Sutherland et al.
5,095,991 A * 3/1992 Milberger ..... 166/380
5,261,487 A 11/1993 McLeod et al.
6,026,675 A * 2/2000 Jansch ..... 73/49.5
6,032,736 A * 3/2000 Williams ..... 166/250.08
6,220,363 B1 4/2001 Dallas
6,247,537 B1 6/2001 Dallas
6,289,993 B1 9/2001 Dallas
6,364,024 B1 4/2002 Dallas
6,470,965 B1 10/2002 Winzer
6,626,245 B1 9/2003 Dallas
6,817,423 B2 11/2004 Dallas
6,918,441 B2 7/2005 Dallas
7,066,269 B2 6/2006 Dallas et al.
7,159,663 B2 1/2007 McGuire et al.
7,207,384 B2 4/2007 Dallas et al.
7,243,733 B2 7/2007 McGuire et al.
7,278,477 B2 10/2007 McGuire et al.

* cited by examiner

*Primary Examiner*—Hoang Dang
(74) *Attorney, Agent, or Firm*—Nelson Mullins Riley & Scarborough, LLP

(57) ABSTRACT

A fixed-point packoff element for a full-bore pressure isolation tool supports a primary seal and a test seal to permit the primary seal to be tested by injecting test fluid through a side port of a tubing head spool before the pressure isolation tool is rigged up for a well stimulation procedure.

13 Claims, 6 Drawing Sheets

FIXED-POINT PACKOFF ELEMENT WITH PRIMARY SEAL TEST CAPABILITY

FIELD OF THE INVENTION

This invention relates in general to hydrocarbon well stimulation equipment and, in particular, to a fixed-point packoff element with primary seal test capability.

BACKGROUND OF THE INVENTION

The inventions of Assignee's pressure isolation tools that provide full-bore access to a casing of the well have revolutionized the well stimulation industry. Full-bore isolation tools seal or "pack off" at a fixed-point above a bit guide in a seal bore of a tubing head spool that supports a production casing in the well, and permit full bore access to the production casing.

A fixed-point packoff element provides a high pressure seal in the tubing head spool seal bore. The full-bore access pressure isolation tools permit stimulation fluid to be pumped into a well at pressures of 15,000+ psi and rates of 300+ bbl/minute. As well, the fixed-point packoff element permits any downhole tool to be run into the casing so that multiple production zones can be stimulated without unrigging frac irons or the full-bore pressure isolation tool.

Since stimulation fluids are commonly pumped into the well at fluid pressures of at least 10,000 psi, the packoff element must provide a very reliable high pressure seal. In order to do so, the packoff element must have an outer diameter that is not more than about 0.005"-0.030" smaller than an inner diameter of the tubing head spool seal bore. As is well understood in the art, an exact inner diameter of a tubing head spool seal bore is not always known with certainty. Consequently, full-bore pressure isolation tools have been rigged up as follows: a packoff element is selected based on a best knowledge of an inner diameter of the tubing head spool seal bore; the packoff element is run it and set; frac irons are hooked up to the full-bore pressure isolation tool and the well is pumped up to test pressure; a tubing head spool side port is monitored for pressure leaks; and, if the packoff element does not contain the test pressure, the test pressure is bled off, the frac irons are disconnected, the pressure isolation tool is removed from the wellhead and the packoff element is changed for a next larger diameter, typically about 0.015" larger. The entire process is then repeated. This can be a time consuming and expensive process.

There therefore exists a need for a fixed-point packoff element with a primary seal test capability to permit primary seal testing prior to rigging up the pressure isolation tool for a well stimulation operation.

SUMMARY OF THE INVENTION

It is therefore an object of the invention to provide a fixed-point packoff element with a primary seal test capability.

The invention therefore provides a fixed-point packoff element, comprising: at least one O-ring groove adapted to receive an O-ring that provides a primary seal between the fixed-point packoff element and a seal bore below a side port of a tubing head spool into which the fixed-point packoff element is inserted; and at least one O-ring groove adapted to receive an O-ring that provides a test seal in a seal bore of the tubing head spool above the side port of the tubing head spool.

The invention further provides a fixed-point packoff element for a high-pressure mandrel of a full-bore pressure isolation tool, comprising: a hollow cylindrical body with a top end and a bottom end and a central passage that extends from the top end to the bottom end; at least one O-ring groove in an outer periphery of the hollow cylindrical body, adapted to receive an O-ring that provides a primary seal between the fixed-point packoff element and a seal bore below a side port of a tubing head spool into which the fixed-point packoff element is inserted; and at least one O-ring groove in the outer periphery of the hollow cylindrical body, adapted to receive an O-ring that provides a test seal in a seal bore of the tubing head spool above the side port of the tubing head spool.

The invention yet further provides a fixed-point packoff element for a high-pressure mandrel of a full-bore pressure isolation tool, comprising: a hollow cylindrical body having a threaded top end for connection to a high-pressure mandrel of the full-bore pressure isolation tool, a bottom end with a bevel adapted to mate with a bit guide in a tubing head spool, and a central passage that extends from the top end to the bottom end in fluid communication with the high-pressure mandrel; a plurality of O-ring grooves in an outer periphery of the hollow cylindrical body, respectively adapted to receive an O-ring that provides a primary seal between the fixed-point packoff element and a seal bore below a side port of a tubing head spool into which the fixed-point packoff element is inserted; and at least one O-ring groove in the outer periphery of the hollow cylindrical body, adapted to receive an O-ring that provides a test seal in a seal bore of the tubing head spool above the side port of the tubing head spool.

BRIEF DESCRIPTION OF THE DRAWINGS

Having thus generally described the nature of the invention, reference will now be made to the accompanying drawings, in which.

DETAILED DESCRIPTION OF THE PREFERRED EMBODIMENTS

The invention provides a fixed-point packoff element for a full-bore pressure isolation tool that permits primary seal testing to facilitate rig up for a well stimulation procedure. The fixed-point packoff element provides a secondary seal in the seal bore above side ports of a tubing head spool. This permits test fluid to be pumped through a side port of the tubing head spool to determine whether a primary seal has been achieved. If the fixed-point packoff element retains the test fluid, a primary seal has been achieved and it can be assumed with a high level of confidence that the fixed-point packoff element will provide a reliable pressure seal at full well stimulation fluid pressure.

Figure 1:
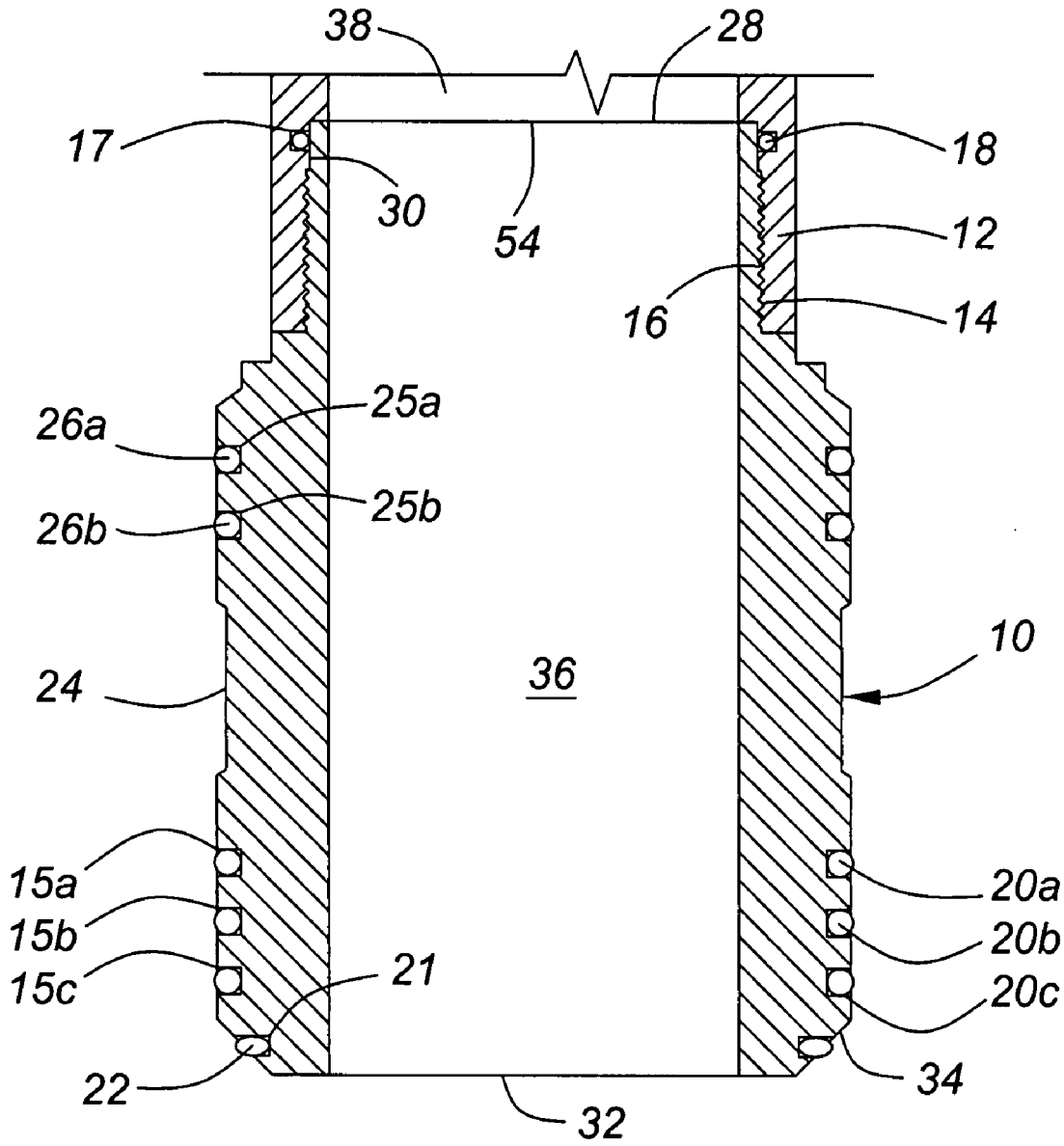
FIG. 1 is a schematic cross-sectional diagram of one embodiment of a fixed-point packoff element in accordance with the invention.

FIG. 1 is a schematic cross-sectional diagram of one embodiment of a fixed-point packoff element 10 in accordance with the invention. The fixed-point packoff element 10 is a hollow cylindrical body connected to a high-pressure mandrel 12 of a full-bore pressure isolation tool (not shown) that is well known in the art. A box thread 14 of the high-pressure mandrel 12 cooperates with a pin thread 16 of the fixed-point packoff element 10 to connect the fixed-point packoff element 10 to the high-pressure mandrel 12. An O-ring groove 17 receives an O-ring 18 that provides a high-pressure seal between the fixed-point packoff element 10 and the high-pressure mandrel 12 to inhibit well stimulation fluids from migrating into the threads 14, 16. At least one O-ring groove, three in this example, 15*a*, 15*b* and 15*c* respectively receive O-rings 20*a*, 20*b* and 20*c* to provide a high-pressure primary seal in a seal bore of a tubing head spool, as will be explained below with reference to FIGS. 3 and 3*a*. An optional O-ring groove 21 receives an O-ring 22 that provides a fluid seal between a bit guide of the tubing head spool and the fixed-point packoff element 10. In this embodiment, a test fluid groove 24 is machined into a periphery of the fixed-point packoff element 10. The test fluid groove 24 is optional. At least one O-ring groove, in this example two O-ring grooves 25*a* and 25*b* respectively receive O-rings 26*a*, 26*b*, that provide a test seal above side ports of the tubing head spool, as will also be explained below with reference to FIGS. 3 and 3*a*.

In this embodiment a top end 28 of the fixed-point packoff element 10 provides a polished seal pin 30 that seals against the O-ring 18. As will be understood by those skilled in the art, a seal bore could be provided in the high-pressure mandrel 12 above the box thread 14, and the O-ring 18 could be carried in an O-ring groove machined in the top end 28 of the packoff element 10. In this embodiment, a bottom end 32 of the packoff element 10 is beveled 34 to mate with the bit guide of the tubing head spool, as will also be explained below with reference to FIG. 3*a*. As is apparent, a central passage 36 through the fixed-point packoff element 10 has an inner diameter equal to an inner diameter of a central passage 38 of the high-pressure mandrel 12. The inner diameter of the central passage 36 is at least as large as an inner diameter of a production casing supported by a tubing head spool into which the fixed-point packoff element is inserted.

Figure 2:
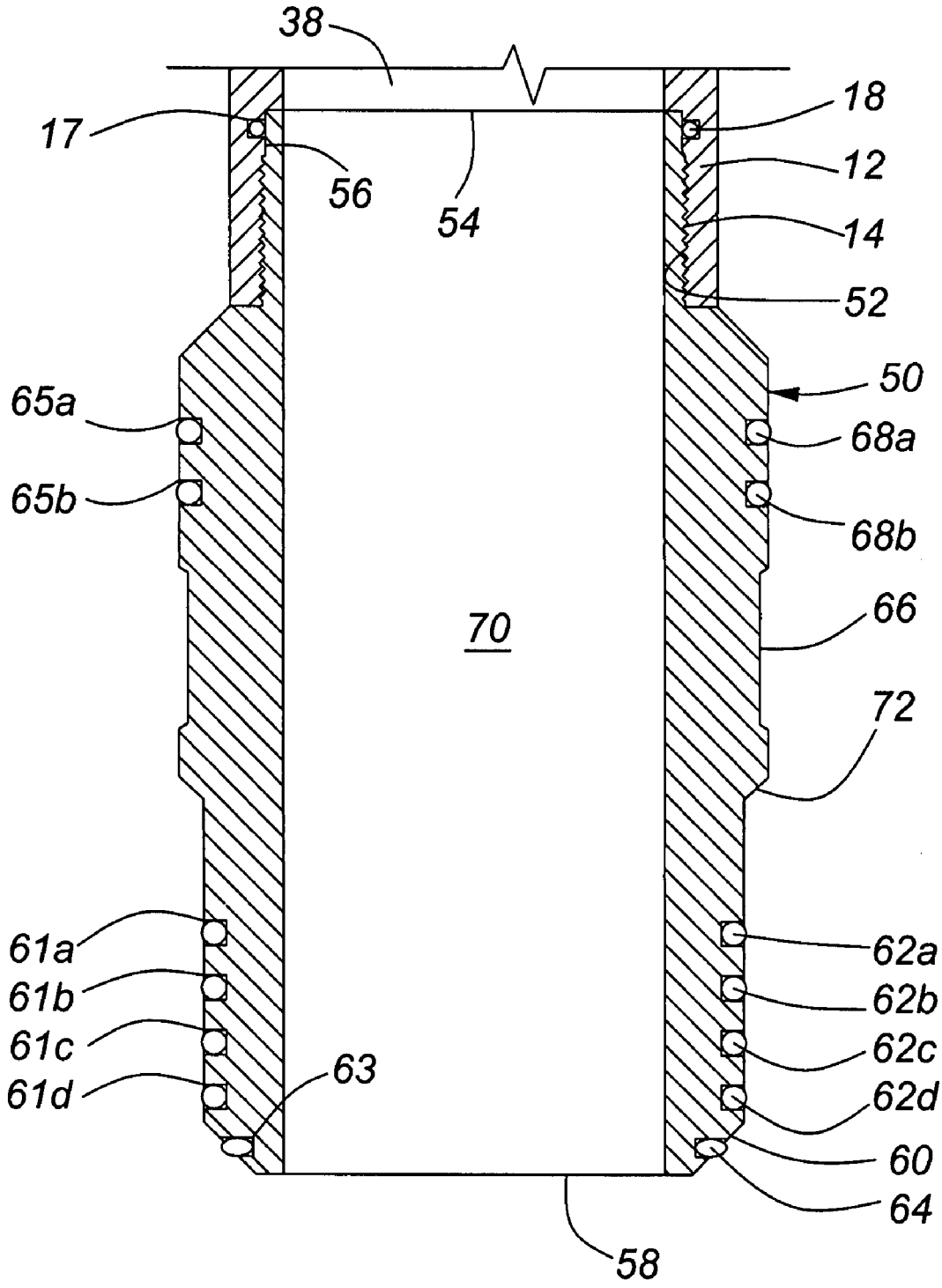
FIG. 2 is a schematic cross-sectional diagram of another embodiment of the fixed-point packoff element in accordance with the invention.

FIG. 2 is a schematic cross-sectional diagram of another embodiment of a fixed-point packoff element 50 in accordance with the invention. The fixed packoff element 50 is substantially identical to the fixed packoff element 10 described above except that the hollow cylindrical body is designed for a tubing head spool in which the seal bore above the bit guide is of a smaller diameter than a seal bore above the side ports of the tubing head spool, as will be explained below in more detail with reference to FIGS. 4 and 4*a*.

The fixed-point packoff element 50 is connected to the box threads 14 by a pin thread 52. The top end 54 includes a seal pin 56 that seals against the O-ring 18, as explained above with reference to FIG. 1. At least one O-ring groove, in this example 4 O-ring grooves 61*a*, 61*b*, 61*c* and 61*d* respectively receive O-rings 62*a*, 62*b*, 62*c* and 62*d* that provide the primary seal. In this embodiment the bottom end 58 includes a bevel 60 that mates with the bit guide, as will be explained below with reference to FIG. 4*a*. An optional O-ring groove 63 receives an O-ring 64 that provides a seal between the bevel 60 and the bit guide to inhibit well stimulation fluid from migrating between the bevel 60 and the bit guide.

An optional test fluid groove 66 is machined around an outer periphery of the fixed-point packoff element 50. A test seal is provided by at least one O-ring received in at least one O-ring groove. In this example, two O-ring grooves 65*a* and 65*b* respectively receive O-rings 68*a*, 68*b* that provide the test seal. A central passage 70 of the fixed-point packoff element 50 has the same inner diameter as the central passage 38 of the high-pressure mandrel 12. The inner diameter of the central passage 70 is at least as large as an inner diameter of a production casing supported by a tubing head spool into which the fixed-point packoff element is inserted. An outer diameter of the fixed-point packoff element 50 increases at a shoulder 72 to conform to an inner diameter of the tubing head spool, as will be explained below with reference to FIG. 4*a*.

Figure 3:
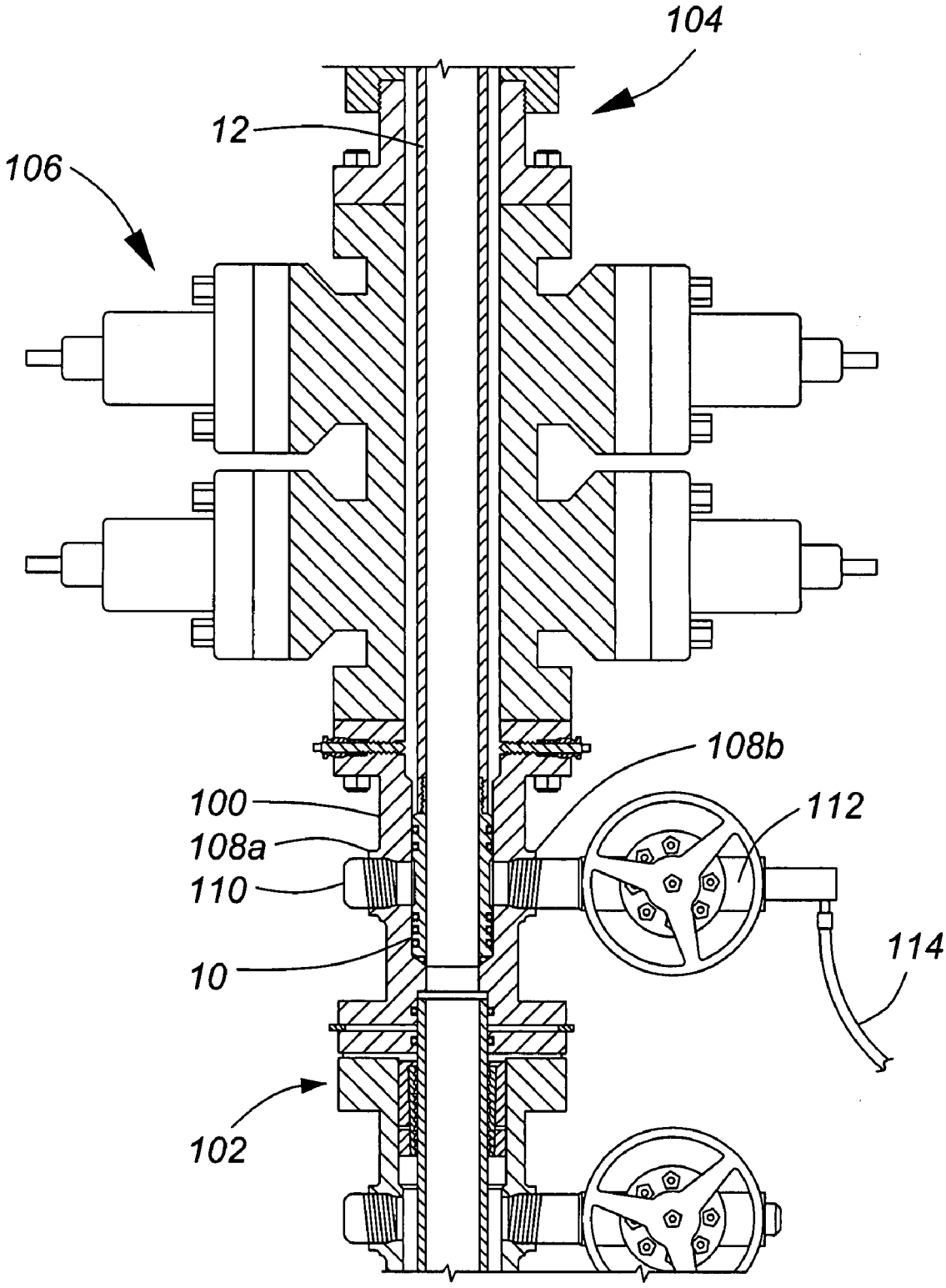
FIG. 3 is a schematic cross-sectional diagram of the fixed-point packoff element shown in FIG. 1 packed off in a seal bore of a tubing head spool of a wellhead.

FIG. 3 is a schematic cross-sectional diagram of the fixed-point packoff element 10 shown in FIG. 1 packed off in a seal bore of a tubing head spool 100 of a wellhead 102. The mandrel 12 of a full-bore isolation tool 104 (only a base of which is shown) has been stroked down through a blowout preventer (BOP) 106 until the fixed-point packoff element 10 rests against the bit guide of the tubing head spool 100. The tubing head spool 100 shown in this example has two side ports 108*a*, 108*b*. The side port 108*a* is sealed with the side port plug 110, well known in the art. The side port 108*b* is equipped with the side port valve 112, also well known in the art. A test fluid line 114 is connected to the side port 112 so that test fluid can be pumped into the test fluid groove 24 to test the primary seal of the fixed-point packoff element 10, as will be explained below with reference to FIG. 3*a*.

Figure 3A:
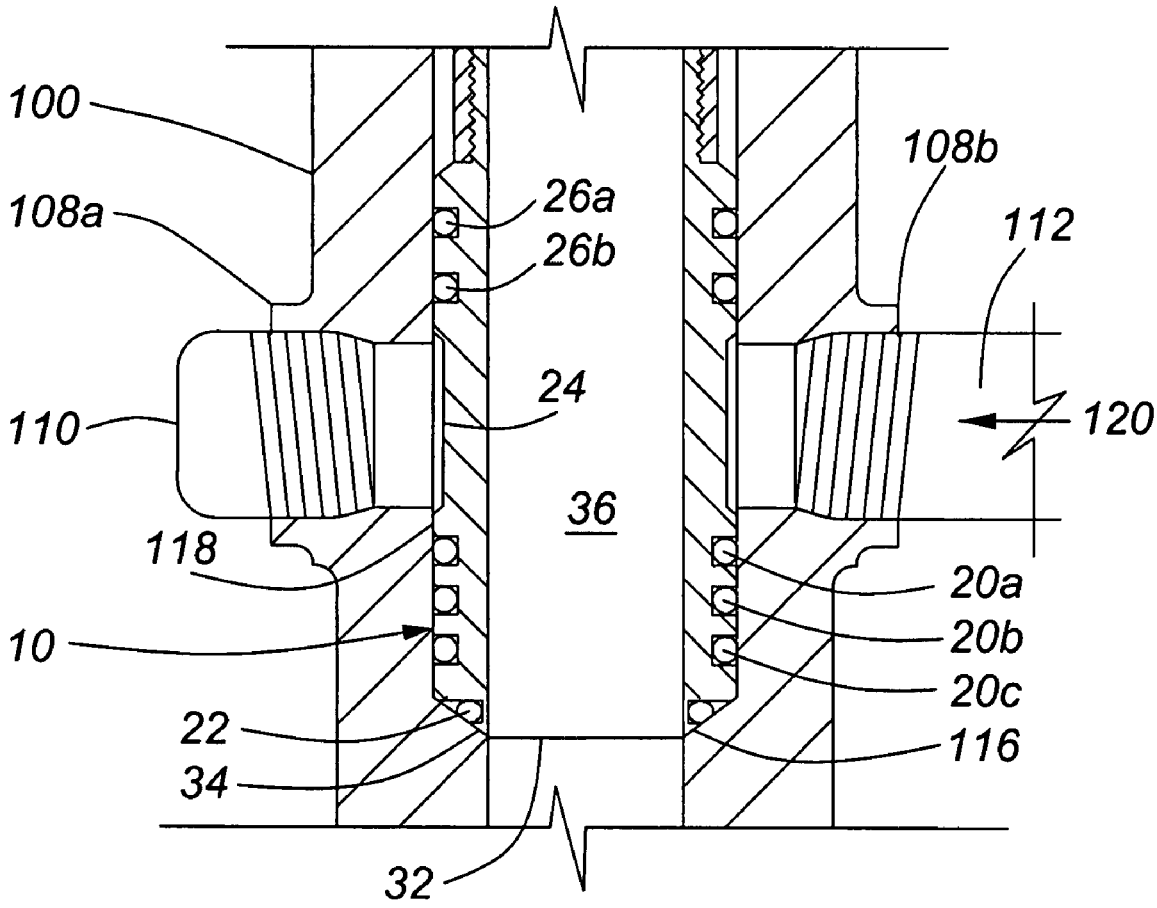
FIG. 3*a* is a schematic cross-sectional diagram of an exploded view of the tubing head spool and fixed-point packoff element shown in FIG. 3.

FIG. 3*a* is a schematic cross-sectional diagram of an exploded view of the fixed-point packoff element 10 shown in FIG. 3. As can be seen, the bevel 34 on the bottom end 32 of the fixed-point packoff element 10 mates with a bit guide 116 of the tubing head spool 100. The O-rings 20*a*, 20*b* and 20*c* provide the primary seal between a seal bore 118 of the tubing head spool 100 and the fixed-point packoff element 10. The O-ring 22 provides a fluid seal between the bevel 34 and the bit guide 116. As also explained above, the test seal is provided by the O-rings 26*a* and 26*b*. Test fluid 120 is injected through the test fluid line 114 and the side port 112 to fill a space defined by the side port valve, the test groove 24 and a space between a sidewall of the fixed-point packoff element 10 and the tubing head spool seal bore 118. The test fluid may be any appropriate fluid, including hydraulic oil, water, air, etc. After the space is filled, the test fluid is pumped to a pressure at or near a rated pressure of the side port valve 112. If the test fluid pressure is maintained by the fixed-point packoff element 10, a primary seal has been achieved and rig up can continue with a high degree of confidence that the fixed-point packoff element will provide a reliable seal at full well stimulation fluid pressure.

If the primary seal is not achieved, either the primary seal O-rings 20*a*, 20*b*, 20*c* or the test seal O-rings 26*a*, 26*b* have failed to seal against the seal bore 118. Consequently, the mandrel 12 is stroked backup through the BOP 106 and the full-bore pressure isolation tool 104 is removed from the BOP 106, so that the fixed-point packoff element 10 can be changed for one of a slightly larger diameter. The new fixed-point packoff element 10 is then stroked down through the BOP and landed against the bit guide 116. The primary seal test is then repeated. All of this is accomplished before frac irons or other well stimulation equipment is connected to the full-bore pressure isolation tool 104. Uncertainty is therefore reduced and time is potentially saved.

Figure 4:
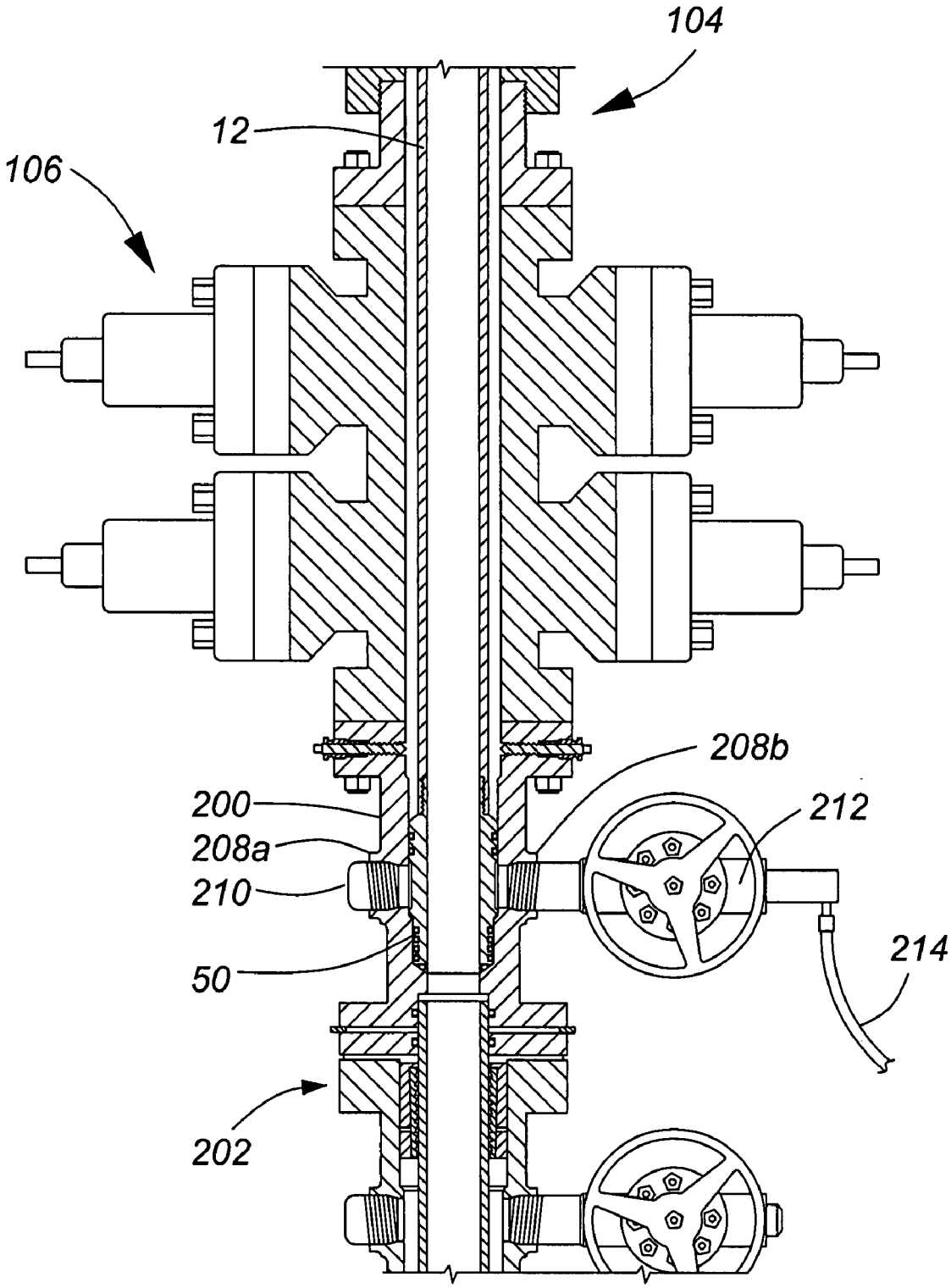
FIG. 4 is a schematic cross-sectional diagram of the fixed-point packoff element shown in FIG. 2 packed off in a seal bore of a tubing head spool of a wellhead.

FIG. 4 is a schematic cross-sectional diagram of the fixed-point packoff element 50 shown in FIG. 2 packed off in a seal bore of a tubing head spool 200 of a wellhead 202. The mandrel 12 of the full-bore pressure isolation tool 104 (only the base of which is shown) has been stroked down through the BOP 106 until the fixed-point packoff element 50 rests against the bit guide of the tubing head spool 200. The tubing head spool 200 shown in this example has two side ports 208*a*, 208*b*. The side port 208*a* is sealed by a side port plug 210. The side port 208*b* is equipped with a side port valve 212, also well known in the art. A test pressure line 214 is connected to the side port 212 so that test fluid can be pumped in to test the primary seal of the fixed-point packoff element 50, as will be explained below with reference to FIG. 4*a*.

Figure 4A:
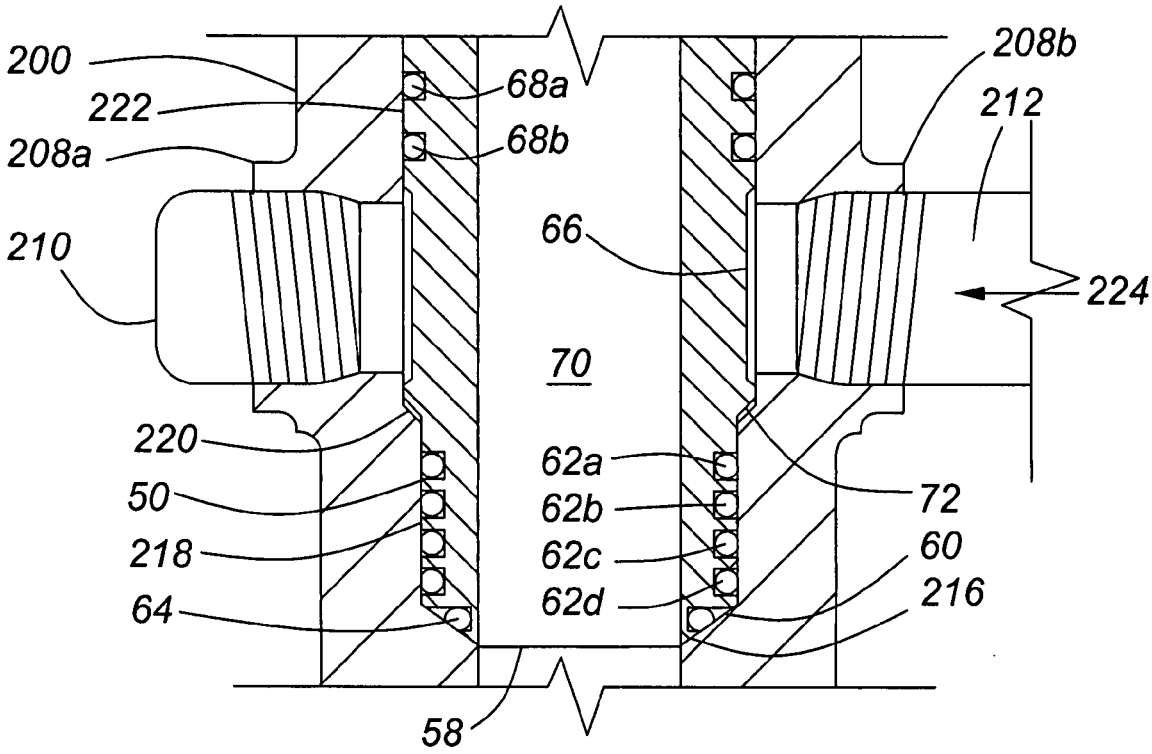
FIG. 4*a* is a schematic cross-sectional diagram of an exploded view of the tubing head spool and the fixed-point packoff element shown in FIG. 4.

FIG. 4*a* is a schematic cross-sectional diagram of an exploded view of the fixed-point packoff element 50 shown in FIG. 4. As can be seen, the bevel 60 on the bottom end 58 of the fixed-point packoff element 50 mates with a bit guide 216 of the tubing head spool 200. The O-rings 62*a*, 62*b*, 62*c* and 62*d* provide the primary seal between a seal bore 218 of the tubing head spool 200 and the fixed-point packoff element 50. The optional O-ring 64 provides a fluid seal between the bevel 60 and the bit guide 216. In this embodiment, the seal bore is stepped at 220 to a larger diameter, and the outer diameter of the fixed-point packoff element 50 increases at the shoulder 72 to conform to an inner diameter of the seal bore 222 of the tubing head spool 200. The test seal is provided by the O-rings 68*a* and 68*b* which seal against the seal bore 222.

Test fluid 224 is injected through the test fluid line 214 and the side port valve 212 to fill a space defined by the side port valve 212 and the sidewall of the fixed-point packoff element between O-rings 62*a* and 68*b*. As explained above, the test fluid may be any appropriate fluid, such as hydraulic oil, water, air, etc. After the space is filled, the test fluid is pumped to a pressure at or near a rated pressure of the side port valve 212. If the test pressure is maintained by the fixed-point packoff element 50, a primary seal has been obtained and rig up can continue with a high degree of confidence that the fixed-point packoff element will provide a reliable seal at full well stimulation fluid pressure. As explained above, if the test pressure is lost, the fixed-point packoff element 50 is changed and the test seal is re-tested.

While two embodiments of the fixed-point packoff element in accordance with the invention have been described, it should be understood that those embodiments are exemplary only.

The scope of the invention is therefore intended to be limited solely by the scope of the appended claims.

I claim:

1. A fixed-point packoff element of a full-bore wellhead isolation tool, comprising:

a hollow body with a continuous sidewall and a central passage that is at least as large as a diameter of a production tubing supported by a tubing head spool of a wellhead isolated by the full-bore wellhead isolation tool, the hollow body having a cylindrical top end and a cylindrical bottom end, the cylindrical top end of the hollow body being adapted to be received in a seal bore above a side port of the tubing head spool and the cylindrical bottom end is adapted to be received in another seal bore below the side port of the tubing head spool;

at least one O-ring groove adapted to receive an O-ring that provides a primary seal between the cylindrical bottom end and the other seal bore below the side port of the tubing head spool;

at least one O-ring groove adapted to receive an O-ring that provides a test seal between the cylindrical top end and the seal bore above the side port of the tubing head spool; and an O-ring groove in a bevel on the cylindrical bottom end that mates with a bit guide of the tubing head spool, the O-ring groove receiving an O-ring that inhibits well stimulation fluid from migrating between the bevel and the bit guide.

2. The fixed-point packoff element as claimed in claim 1 comprising three O-ring grooves respectively adapted to receive O-rings that provide the primary seal.

3. The fixed-point packoff element as claimed in claim 1 comprising four O-ring grooves respectively adapted to receive O-rings that provide the primary seal.

4. The fixed-point packoff element as claimed in claim 1 comprising two O-ring grooves respectively adapted to receive O-rings that provide the test seal.

5. The fixed-point packoff element as claimed in claim 1 further comprising a test fluid groove machined into the continuous sidewall of the hollow body between the cylindrical bottom end and the cylindrical top end.

6. The fixed-point packoff element as claimed in claim 1 wherein the cylindrical top end comprises a pin thread that cooperates with a box thread of a high-pressure mandrel of the full-bore wellhead isolation tool to connect the fixed-point packoff element to the high-pressure mandrel.

7. The fixed-point packoff element as claimed in claim 6 further comprising a seal pin above the pin thread, the seal pin cooperating with an O-ring received in an O-ring groove above the box thread of the high-pressure mandrel to provide a seal to inhibit well stimulation fluid from migrating into the pin thread and the box thread.

8. A fixed-point packoff element for a high-pressure mandrel of a full-bore wellhead isolation tool, comprising:

a hollow body with a continuous sidewall having a cylindrical top end and a cylindrical bottom end and a central passage at least as large as an internal diameter of a casing supported by a wellhead that is pressure isolated by the full-bore wellhead isolation tool, the central passage extending from the cylindrical top end to the cylindrical bottom end, the cylindrical top end of the hollow body being adapted to be received in a seal bore above a side port of a tubing head spool of the wellhead and having a larger outer diameter than an outer diameter of the cylindrical bottom end, which is adapted to be received in a seal bore below the side port of the tubing head spool;

at least one O-ring groove in an outer periphery of the cylindrical bottom end of the hollow body, the at least one O-ring groove being adapted to receive an O-ring that provides a primary seal between the cylindrical bottom end and the seal bore below the side port of the tubing head spool;

at least one O-ring groove in the outer periphery of the cylindrical top end of the hollow body, the at least one O-ring groove being adapted to receive an O-ring that provides a test seal in the seal bore above the side port of the tubing head spool; and an O-ring groove in a bevel on the cylindrical bottom end that mates with a bit guide of the tubing head spool, the O-ring groove receiving an O-ring that inhibits well stimulation fluid from migrating between the bevel and the bit guide.

9. The fixed-point packoff element as claimed in claim 8 comprising 3 O-ring grooves for respectively receiving O-ring seals for providing the primary seal.

10. The fixed-point packoff element as claimed in claim 8 comprising 4 O-ring grooves for respectively receiving O-ring seals for providing the primary seal.

11. The fixed-point packoff element as claimed in claim 8 comprising 2 O-ring grooves for respectively receiving O-ring seals for providing the test seal.

12. A fixed-point packoff element for a high-pressure mandrel of a full-bore wellhead isolation tool, comprising:

a hollow body having a continuous sidewall with an outer diameter that increases from a first diameter to a second, larger diameter to respectively conform to an inner diameter of a lower seal bore below a side port of a tubing head spool and a larger upper seal bore above the side port of the tubing head spool into which the fixed-point packoff element is inserted, the hollow body comprising a cylindrical top end received in the upper seal bore, the cylindrical top end including a thread for connection to a high-pressure mandrel of the full-bore wellhead isolation tool, a cylindrical bottom adapted to be received in the lower seal bore, the cylindrical bottom end including a bevel adapted to mate with a bit guide in the tubing head spool, and a central passage that extends from the cylindrical top end to the cylindrical bottom end in fluid communication with the high-pressure mandrel;

a plurality of O-ring grooves in an outer periphery of the cylindrical bottom end, respectively adapted to receive O-rings that provide a primary seal between the cylindrical bottom end and the lower seal bore of the tubing head spool;

at least one O-ring groove in the outer periphery of the hollow cylindrical top end, adapted to receive an O-ring that provides a test seal between the cylindrical top end and the upper seal bore of the tubing head spool; and an O-ring groove in the bevel adapted to receive an O-ring for providing a fluid seal between the bevel and the bit guide when the fixed-point packoff element is seated on the bit guide.

13. The fixed-point packoff element as claimed in claim 12 further comprising a test fluid groove in an outer periphery of the hollow body between the cylindrical top end and the cylindrical bottom end.

* * * * *